US010077517B2

(12) United States Patent
Whitley et al.

(10) Patent No.: US 10,077,517 B2
(45) Date of Patent: Sep. 18, 2018

(54) TEXTILE PRODUCT HAVING THINNED REGIONS

(71) Applicant: Apple Inc., Cupertino, CA (US)

(72) Inventors: James C. Whitley, San Francisco, CA (US); John J. Baker, Cupertino, CA (US); Kathryn P. Crews, San Francisco, CA (US); Yoji Hamada, Tokyo (JP)

(73) Assignee: Apple Inc., Cupertino, CA (US)

( * ) Notice: Subject to any disclaimer, the term of this patent is extended or adjusted under 35 U.S.C. 154(b) by 779 days.

(21) Appl. No.: 13/794,135

(22) Filed: Mar. 11, 2013

(65) Prior Publication Data

US 2014/0255663 A1 Sep. 11, 2014

(51) Int. Cl.
*D04H 1/74* (2006.01)
*D04H 1/62* (2006.01)

(52) U.S. Cl.
CPC ..... *D04H 1/74* (2013.01); *D04H 1/62* (2013.01); *Y10T 428/2481* (2015.01)

(58) Field of Classification Search
CPC ..... H05K 1/038; A45C 13/002
See application file for complete search history.

(56) References Cited

U.S. PATENT DOCUMENTS 3,906,130 A 9/1975 Tsurumi et al.
4,704,112 A 11/1987 Suzuki et al.
4,789,592 A * 12/1988 Taniguchi ..... C09J 167/00 428/373
5,814,389 A 9/1998 Giacometti et al.
6,228,462 B1 5/2001 Lee et al.
7,581,294 B2 9/2009 Dilo
8,557,169 B2 10/2013 Gross et al.
2010/0285101 A1* 11/2010 Moore ..... B32B 5/14 424/445
2010/0291213 A1* 11/2010 Berrigan ..... D04H 1/42 424/484
2013/0004757 A1* 1/2013 Isele et al. ..... 428/219
2013/0048514 A1* 2/2013 Corcoran ..... A45C 3/02 206/45.23
2013/0101805 A1* 4/2013 Altshuler et al. ..... 428/172
2014/0272209 A1 9/2014 Stanley et al.

* cited by examiner

*Primary Examiner* — Chinessa T. Golden

(74) *Attorney, Agent, or Firm* — Joseph F. Guihan

(57) ABSTRACT

Embodiments described herein may take the form of a textile fabric, including: a first region defined by a first plurality of textile fibers; a second region adjacent the first region and being formed from a second plurality of textile fibers and a hot melt material adjacent the second plurality of textile fibers; wherein the first region is free of hot melt material. Other embodiments may take the form of a method for fabricating a textile product, including the operations of: applying heat to a textile having associated hot melt fibers, thereby melting the hot melt fibers; modifying a mechanical property of a portion of the textile by introducing a solvent to the textile; and stopping an action of the solvent on the textile when the mechanical property reaches a target.

20 Claims, 7 Drawing Sheets

TEXTILE PRODUCT HAVING THINNED REGIONS

TECHNICAL FIELD

Embodiments described herein relate generally to a nonwoven textile product, and more particularly to a nonwoven textile product having one or more reduced density or thinned regions and one or more full density regions.

BACKGROUND

Textile products have been in use for thousands of years and come in many forms. One way to classify textile products is by whether they are woven products (such as cotton products) or non-woven products (such as felt products). Generally, both have many applications and are widely used. Generally, "woven" products, as used herein, includes knitted textile products One example of a nonwoven textile is felt, which has been used to make goods for centuries. Felt may be formed by placing randomly aligned wool and/or synthetic fibers under pressure and adding moisture, and optionally chemicals. With sufficient time, heat and water, the fibers bond to one another to form a felt cloth. This process may be known as "wet felting."

As another option, fibers may be formed into a felt through "needle felting." In needle felting, a specialized notched needle is pushed repeatedly in and out of a bundle or group fibers. Notches along the shaft of the needle may grab fibers in a top layer of the bundle and push them downward into the bundle, tangling these grabbed fibers with others. The needle notches face toward the felt bundle, such that the grabbed felt is released when the needle withdraws. As the needle motion continues, more and more fibers are tangled and bonded together, again creating a felt cloth.

Although two different ways to create felt products have been described, it should be appreciated that variants and/or other methods may be employed. Regardless of the production method, however, felts share certain characteristics. For example, felts are often used as an acoustic damper due to their relatively dense natures. Likewise, felt tends to pull apart readily, due to its nonwoven nature, if the integrity of the bonds between the threads is compromised. This tendency to break apart when subjected to certain stresses and/or chemical may limit the usefulness of felt for certain applications.

SUMMARY

Embodiments described herein may take the form of a textile fabric, including: a first region defined by a first plurality of textile fibers; a second region adjacent the first area and being formed from a second plurality of textile fibers and a hot melt material adjacent the second plurality of textile fibers; wherein the first region is free of hot melt material.

Other embodiments may take the form of a method for fabricating a textile product, including the operations of: applying heat to a textile having associated hot melt fibers, thereby melting the hot melt fibers; modifying a mechanical property of a portion of the textile by introducing a solvent to the textile; and stopping an action of the solvent on the textile when the mechanical property reaches a target.

Additional embodiments and configurations will be apparent upon reading this disclosure.

DETAILED DESCRIPTION

Embodiments described herein may take the form of a textile product having one or more selectively thinned or weakened regions. In certain embodiments, the textile may be a woven fabric, such as a cotton, polyester or the like. In other embodiments, the textile may be a nonwoven fabric, such as a felt.

Generally, some or all strands of material forming the textile may be interspersed with, at least partially encircled by, interwoven with, or otherwise associated with a hot melt fiber. This hot melt fiber may be incorporated into the textile at specific areas or volumes or may be incorporated into the entirety of the textile. Likewise, the density of the hot melt material with respect to the fibers may vary (e.g., more or fewer hot melt fibers per area or volume of textile may be employed in certain regions), as may the thickness of the hot melt fibers, the number of hot melt fibers, the ratio of hot melt fibers to textile fibers, and so on. It should be appreciated that such variations may occur only in certain portions, segments or areas of the textile. Likewise, multiple variations may occur in multiple portions.

Generally, references to an "area" herein are intended to also encompass three-dimensional areas, e.g., volumes. Likewise, the term "region" encompasses both an area and a volume.

As described in more detail below, the hot melt fibers may be melted onto or into the textile, at least in certain areas or volumes, through the application of heat. Sufficient heat may cause the hot melt fibers to melt and flow into a protective matrix, thereby at least partially coating and/or bonding textile fibers positioned near or adjacent the protective matrix. Generally, the melting point of the hot melt fiber is lower than a melting point of the textile fabric, and often below a temperature at which the fabric may scorch or burn.

Typically, the hot melt material is chosen to be impervious to one or more solvents that may dissolve or otherwise weaken the textile fabric. Thus, when a textile product is exposed to a solvent after the protective matrix is formed by the hot melt, the matrix may prevent the solvent from affecting protected portions of the textile fabric. Meanwhile, unprotected portions of the textile fabric may be weakened, dissolved, removed, thinned, decreased in density, or the like by the solvent. By selectively applying and/or melting the hot melt fibers, certain areas or volumes may be protected from the action of the solvent while others are exposed. In this fashion, various patterns may be created in a textile for a variety of effects, many of which are discussed herein.

Figure 1:
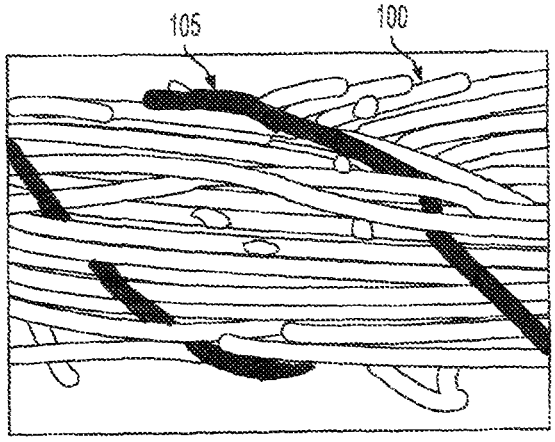
FIG. 1 depicts a magnified view of a portion of a fabric incorporating hot melt fiber.

FIG. 1 shows a sample bundle of textile fibers 100 wrapped about with a hot melt fiber 105. The hot melt fiber 105 is shown generally encircling the bundle of fibers 100, although in alternative embodiments the relationship between the hot melt fiber and bundle of textile fibers may be different. For example, the hot melt fibers may overlay the textile fibers, such that the hot melt fibers and the textile fibers essentially occupy different adjacent planes of a textile object. As another alternative, the hot melt fibers 105 may be interspersed or interwoven with the textile fibers 100 throughout a textile product. Both alternatives will be discussed in more detail, below. Further, it should be appreciated that the hot melt fiber may underlay some textile fibers and still generally encircle the fibers. For example, and as shown in FIG. 1, the hot melt fiber 105 (the dark fiber) is wrapped around a bundle of fibers 100 but passes beneath some of them, at least on some windings of the hot melt fiber 105.

Continuing with the description of FIG. 1, the diameter of the hot melt fiber 105 may be substantially less than the diameter of the bundle of textile fibers 100 or, in some embodiments, less than the diameter of any individual textile fiber. The relative diameters of the hot melt fiber and the textile fibers may influence the dispersion of the hot melt fibers within the textile. For example, thinner hot melt fibers may require the use of more fibers to cover or impregnate a given area or volume of textile. Likewise, thicker hot melt fibers may allow fewer fibers to be used in a given area or volume.

It should also be appreciated that the bundle of fibers 100 shown in FIG. 1 is formed from woven fibers. However, nonwoven fibers may also be use in some embodiments, with hot melt fibers 105 snaking through the nonwoven fibers, overlaying the nonwoven fibers, or encircling such fibers.

Figure 2:
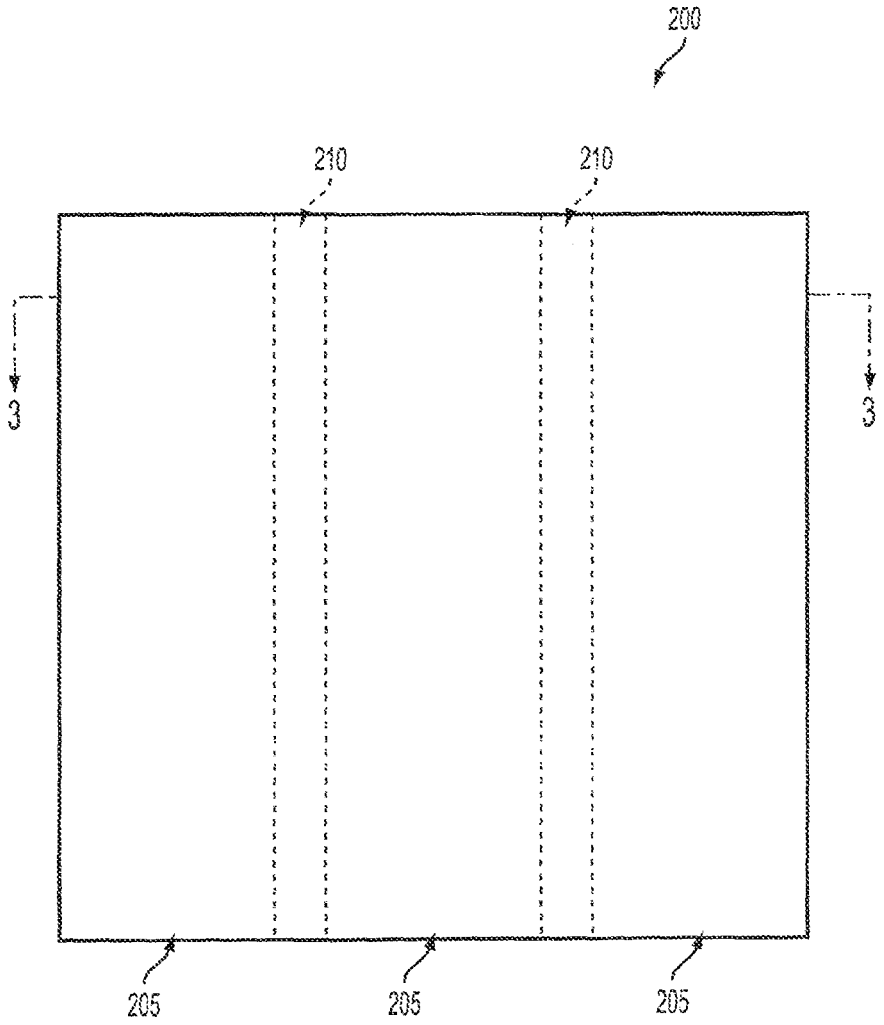
FIG. 2 depicts a sheet of textile material.

FIG. 2 illustrates a sample textile sheet 200 that may be formed into a cover for a tablet computing device (not shown) in accordance with the discussion and methods herein. The textile sheet 200 may be formed from textile fibers 100 (woven or nonwoven) and hot melt fibers 105, as discussed above. Generally, the textile sheet 200 is patterned into a series of hot melt areas/volumes 205 and non-melt areas/volumes 210. The hot melt areas 205 may have hot melt fibers 105 present therein, while the non-melt areas 210 may lack hot melt fibers.

Figure 3A:
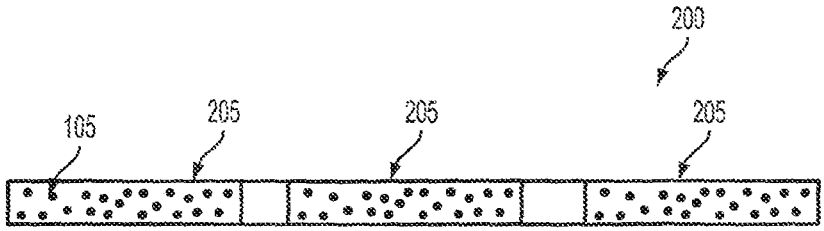
FIG. 3A depicts a first example of the fiber textile sheet of FIG. 2 after selectively heating portions of the sheet.
Figure 3B:
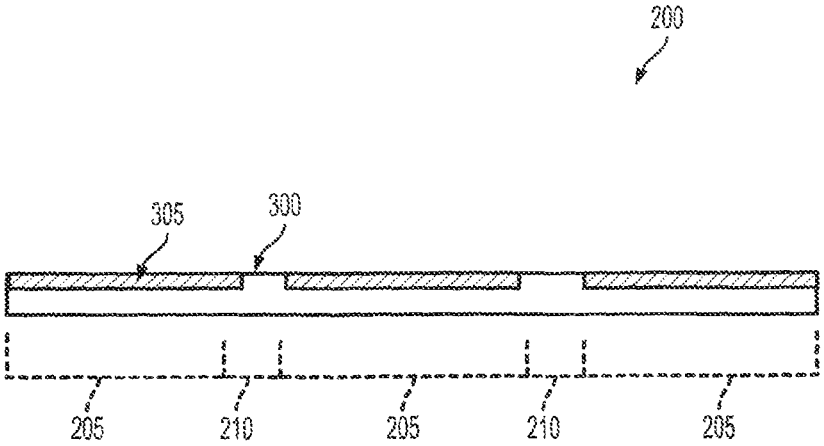
FIG. 3B depicts a second example of the fiber textile sheet of FIG. 2 after selectively heating portions of the sheet.

For example, FIGS. 3A and 3B depict alternative examples of the textile sheet 200 with hot melt fibers 105 in the hot melt areas 205. In the example of FIG. 3A, the hot melt fibers 105 are interspersed throughout the textile sheet 200 in each hot melt area 200. That is, the hot melt fibers may run randomly or semi-randomly throughout the hot melt areas of the textile sheet. As can be seen in FIG. 3A, there are generally no (or very few, or only incidental) hot melt fibers in the non-melt regions 210. In alternative embodiments, the hot melt fibers 105 may extend throughout or into the non-melt regions 210. In such embodiments, heat may not be applied to the non-melt regions, thereby preventing the hot melt fibers from melting in that area and leaving the textile fibers exposed.

FIG. 3B illustrates an alternative textile fiber sheet 200 having hot melt fiber 105 associated therewith. In this embodiment, the hot melt fiber 105 may impregnate or wrap only a portion of the textile fibers 100 to define a hot melt area 205, specifically those on an upper surface 300 of the textile sheet 200. As an alternative, the hot melt fibers 105 may be deposited on an upper surface 300 of the textile sheet in specific patterns 305 or shapes to form the hot melt areas 205 and non-melt areas 210.

Figure 4:
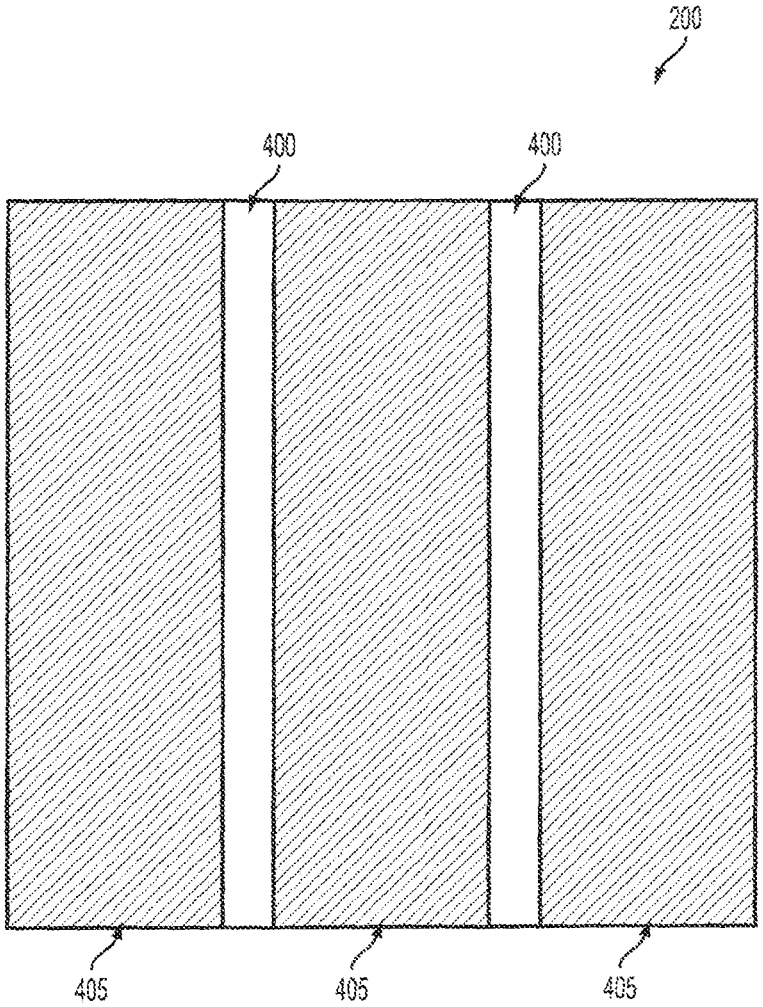
FIG. 4 depicts the sheet of FIG. 3 after application of a solvent.

The discussion now turns to FIG. 4. FIG. 4 depicts the textile sheet 200 after application of heat and a solvent. As discussed below with respect to FIG. 6, heat mat be applied at least to the upper surface 300 of the textile sheet 200 (or whichever surface is impregnated with, wrapped by, overlaid by, or otherwise contains the hot melt fibers 105). In alternative embodiments, the entirety of the textile sheet 200 may be heated.

The heat generally causes the hot melt fibers 105 to melt, wicking across the textile fibers 100. The hot melt fibers 105 may spread across an entirety of adjacent textile fibers 100 or may partially envelop or shield the textile fibers. As one other example, the hot melt fibers may coat the textile fibers at intersections between adjacent textile fibers and taper out from such intersections along the lengths of the fibers. This may have the added effect of strengthening such intersections, and may be particularly useful in the fabric is a nonwoven material, such as felt, since the bond between adjacent nonwoven fibers may be strengthened by the hot melt. Further, it should be appreciated that the hot melt fibers, when melted onto the textile fibers, need not form a contiguous or continuous surface. The melting of the hot melt fibers 105 may form hot melt areas or volumes 405 where the textile fabric is covered or impregnated with the hot melt and unprotected areas or volumes 400 that lack any hot melt.

A solvent may be applied to the textile sheet 200 after the hot melt fibers 105 are melted. The solvent may be applied as a bath or may be forced through the textile by pressure and/or gravity. For example, the textile sheet 200 may be pressure washed with a solvent. Alternatively, the textile sheet may be dipped into a solvent or placed into a solvent bath. In many embodiments, the solvent may be forced or fed through the textile sheet 200 from the upper surface 300 (e.g., the surface associated with the now-melted hot melt fibers 105).

The solvent may dissolve, partially dissolve, or weaken the textile fibers 100. However, the hot melt fibers 105 are typically impervious, or at least resistant, to the solvent. Thus, in regions where the hot melt fibers 105 have been melted, the hot melt may protect the textile fibers 100 from the action of the solvent. In this fashion, the textile sheet may be thinned in regions 400 that lack any hot melt materials, while the hot melt regions 405 are unaffected by the solvent. After the solvent has sufficiently thinned or weakened the textile fibers in the unprotected regions 400, the textile sheet 200 may be washed or otherwise cleaned of the solvent.

Selectively thinning, weakening or perforating the textile sheet 200 in specific areas 400 (generally corresponding to the non-melt areas 210) to form a desired pattern may provide certain benefits. For example, the unprotected areas 400 may be altered to be acoustically transmissive or transparent, or near-transparent, even though the textile itself generally may be an acoustic muffle. Likewise, the unprotected areas 400 may be thinned or changed sufficiently by the solvent to be light-transmissive, at least partially. For example, the unprotected areas may appear translucent when backlighted or may emit a relatively diffuse light, or may be at least partially see-through when backlit. As yet another example, the textile sheet may bend more easily in the unprotected areas 400 after operation of the solvent while the hot melt areas 405 may retain their original stiffness. Thus, by selectively masking portions of the textile sheet with hot melt 105, the textile sheet 200 may be configured to provide certain functionality that is otherwise lacking in a standard textile sheet 200.

Figure 5:
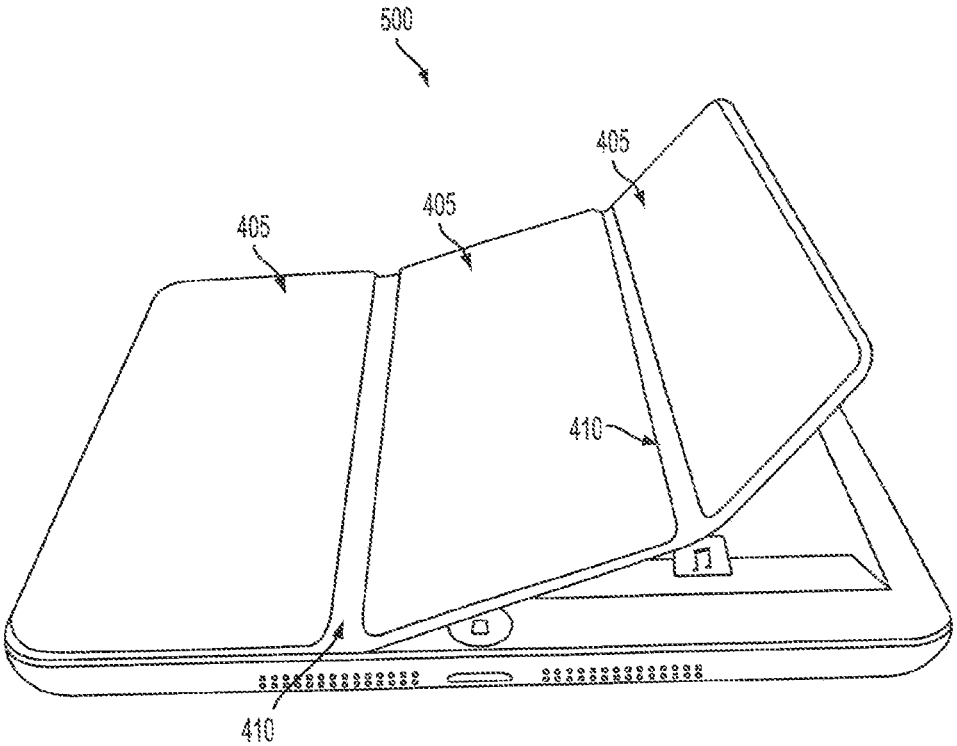
FIG. 5 is a sample method of manufacturing a textile product having thinned regions.

FIG. 5 shows one example of a cover 500 for an electronic device that may be formed from a textile sheet treated as discussed herein. Generally, the cover 500 may be a finished product corresponding to the textile sheet 200 shown in FIGS. 2 and 4. The cover may bend at the unprotected areas 400 as they have been softened by the action of the solvent. The hot melt areas 405 may be relatively stiff when compared to the unprotected areas. Thus, the cover 500 may be configured to selectively bend and/or be reshaped.

Figure 6:
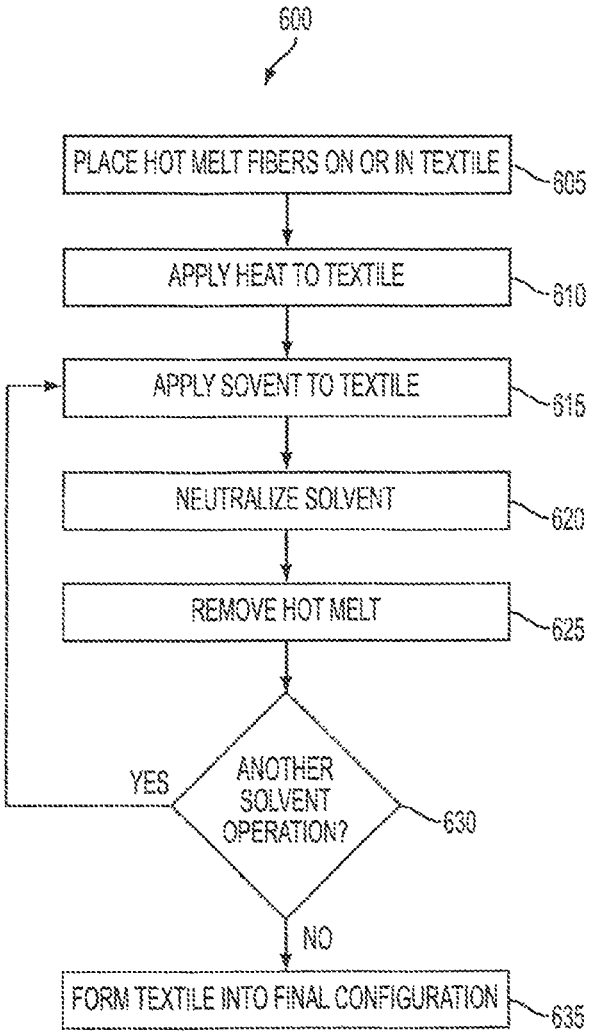
FIG. 6 shows a sample consumer product formed from a textile product having thinned regions.

FIG. 6 is a flowchart setting forth general operations in accordance with certain embodiments herein. In operation 600, hot melt fibers 105 are added to a textile sheet 200 to form a particular pattern or patterns. The hot melt fibers may be added or introduced in any fashion described herein.

In operation 605, heat is applied to the textile sheet 200. The heat may be uniformly applied, concentrated or applied only in certain areas (like those areas incorporating hot melt fibers 105), applied to fewer than all sides or edges, or the like, and so on. The heat is typically sufficient to flow the hot melt fibers 105. The maximum heat may be less than a burning or scorching temperature of the textile sheet, or the heat may be applied for a time sufficient to flow the hot melt fibers but not to damage the textile fibers. In embodiments where the hot melt fibers are generally interspersed or placed throughout the entirety of the textile fabric, heat may be selectively applied only to those regions in which the hot melt fibers are to be melted.

Next, in operation 610, solvent is applied to the textile sheet 200. The solvent may be poured or pushed through the textile sheet 200 in some embodiments, while in others the textile sheet may be placed or laid face-down in a solvent bath. The solvent generally weakens, things, and/or reduces the density of the textile fibers, which are vulnerable to the action of the solvent (e.g., are solvable). After the solvent thins or weakens the textile fibers 105 that are not protected by hot melt, the solvent may be removed or neutralized in operation 615.

In operation 620, the hot melt 105 may optionally be removed from the textile sheet. Removal of the hot melt 105 may be practical, for example, in embodiments where the hot melt coats a surface of the textile sheet 200 rather than being incorporated into the sheet. Removal may also be practical in embodiments where only a portion of the textile sheet 200 is impregnated with hot melt. This operation is optional and may not be performed in many embodiments. Likewise, hot melt may be removed in certain areas only and left in other areas of a textile sheet 200. Further, it should be appreciated that some embodiments may perform this operation before applying solvent in order to define features within a hot melt region 405 that may be affected by the solvent. As one example, an entire surface of a textile sheet 200 may be protected by hot melt 105 and the hot melt may be specifically removed from certain regions to permit the solvent to operate on the textile fibers 105.

In operation 625, it may be determined if another solvent operation (e.g., a bath, a stream or the like) is to be applied to the textile sheet 200. Multiple solvent applications may be made when different features are to be formed in the textile sheet, as one example. Such features may be of different thicknesses or strengths, as another example, and thus may be exposed to solvent for differing periods of time. As yet another option, or in addition to the foregoing, multiple different types of solvent may be employed in multiple applications of solvent to the textile.

If another solvent operation is required or desired, the method may return to operation 610. Otherwise, operation 630 is accessed and the textile may be formed into a final configuration. The textile maybe cut or shaped, for example. In many embodiments, operation 630 may be omitted.

Figure 7:
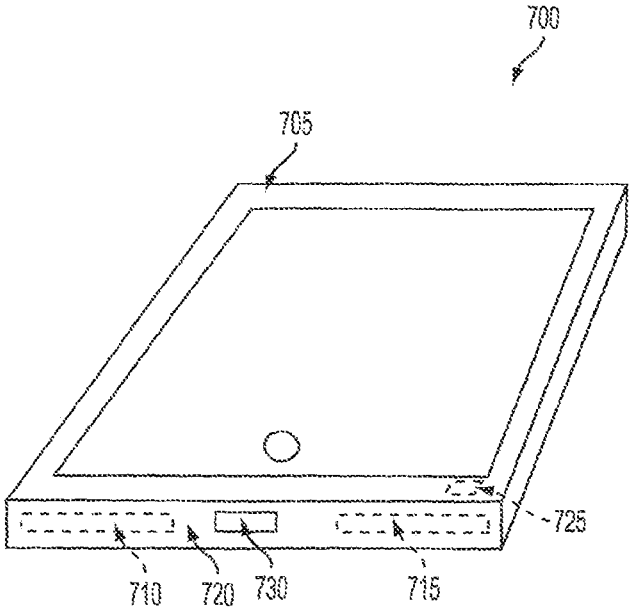
FIG. 7 shows a second sample consumer product formed from a textile product having thinned regions.

It should be appreciated that a variety of items may be made from a textile fabric 200 selectively treated with a hot melt material 105. For example, a variety of covers or cases may be formed. FIG. 7 shows one example of an exterior case 700 for a tablet computing device 705 that may be formed in accordance with the present disclosure. The case 700 may define one or more acoustic outlets 710 and/or acoustic inlets 715. These acoustic outlets/inlets may be unprotected regions 400 that were exposed to solvent, thereby thinning the textile fabric sufficiently to permit sound to pass therethrough without substantial impedance or distortion. An acoustic outlet 710 may cover a speaker of the tablet computing device 705 while an acoustic inlet 715 may cover a microphone, for example. It should be appreciated that the look of these acoustic outlets 710 and inlets 715 may be identical or substantially similar to the rest of the case 700, including any portions 720 that were protected from the action of the solvent by hot melt 105. Thus, although the acoustic properties of the outlets 710 and inlets 715 may be altered, the visual appearance, and optionally the feel, of these elements may match the rest of the case. The dashed lines signify that these elements, while transmissive, may not form an aperture permitting objects to pass through the textile fabric.

The case 700 may also define a light-transmissive section 725. The light-transmissive section may emit light when backlit. For example, when a status indicator is activated, the outputted light may be visible through the light-transmissive section. In some embodiments the light may be visible even though the status indicator is not.

Through multiple solvent applications, or through the use of varying concentrations of solvents selectively applied simultaneously, one or more apertures 730 passing through the textile 700 may be formed in the textile material.

It should be appreciated that any number of items may be formed from a textile fabric that is selectively altered in the fashions described herein. For example, textile seat covers for automobiles may be so manufactured. Likewise, grilles or covers for audio elements, such as speakers, may be formed. As still another example, bands or bracelets may be fabricated in this fashion. Covers for other electronic devices, such as telephones and notebook computers, may also be created. Various other products will become apparent to those of ordinary skill in the art upon reading this disclosure in its entirety. Accordingly, the proper scope of protection is set forth in the appended claims.

We claim:

1. A textile fabric, comprising:

a first region defined by a first plurality of textile fibers;

a second region adjacent to and non-overlapping with the first region, wherein the second region comprises a second plurality of textile fibers and a hot melt material positioned on the second plurality of textile fibers and wherein the first region is free of hot melt material; and a third region adjacent to and non-overlapping with the first region, wherein the third region comprises a third plurality of textile fibers and an additional hot melt material positioned on the third plurality of textile fibers, wherein the first region is interposed between the second and third regions, wherein the second and third regions are stiffer than the first region, wherein the first region has a longitudinal axis, and wherein the third region is configured to rotate relative to the second region about the longitudinal axis.

2. The textile fabric of claim 1, wherein:

the hot melt material comprises a plurality of hot melt fibers; and the plurality of hot melt fibers are wrapped about at least a portion of the second plurality of textile fibers.

3. The textile fabric of claim 1, wherein:

the hot melt material comprises a plurality of hot melt fibers; and the plurality of hot melt fibers are impregnated within at least a portion of the second plurality of textile fibers.

4. The textile fabric of claim 1, wherein at least some of the hot melt material surrounds an intersection of at least some of the second plurality of fibers, thereby strengthening the intersection.

5. The textile fabric of claim 1, wherein the textile fabric is a nonwoven material.

6. The textile fabric of claim 1, wherein the first region is thinned in comparison to the second region.

7. The textile fabric of claim 1, wherein the first region provides superior acoustic transmissivity in comparison to the second region.

8. The textile fabric of claim 1, wherein the first region provides superior light transmissivity in comparison to the second region.

9. The textile fabric of claim 1, wherein the first region encircles the second region.

10. The textile fabric of claim 1, wherein the hot melt material is resistant to dissolution by a solvent, the solvent being configured to one of dissolve or weaken the textile fibers of the first region or the second region.

11. The textile fabric of claim 10, wherein the hot melt material protects the textile fibers of the second region from the solvent.

12. The textile fabric of claim 1, wherein a diameter of the hot melt material is less than a diameter of the textile fibers of the second region.

13. The textile fabric of claim 1, wherein the hot melt material is positioned adjacent a portion of the second plurality of textile fibers of the second region to form an upper surface of the textile fabric at the second region.

14. The textile fabric of claim 1, wherein the hot melt material comprises a melting temperature lower than a melting temperature of the first and second plurality of textile fibers.

15. A cover for an electronic display, wherein the cover is configured to vertically overlap the electronic display, the cover comprising:

a first panel and a second panel, each of the first and second panels comprising a plurality of textile fibers and a material positioned on at least a portion of the plurality of textile fibers, wherein the material comprises a melting temperature lower than a melting temperature of the plurality of textile fibers; and a connecting member interposed between the first panel and the second panel and having another plurality of fibers free of the material, wherein the first panel has a first height, a first length, and a first width, the second panel has a second height, a second length, and a second width, and the connecting member has a third height, a third length, and a third width, wherein the third width is less than the first width, wherein the third width is less than the second width, wherein the first, second, and third lengths are the same, wherein the connecting member has a longitudinal axis extending parallel to the third length of the connecting member, and wherein the first panel is rotatable about the longitudinal axis of the connecting member relative to the second panel while the first panel and the second panel remain planar.

16. The cover of claim 15, wherein the first panel is configured for removable engagement with a display window of an electronic device.

17. The cover of claim 15, where the connecting member is chemically treated by a solvent such that the connecting member comprises a lesser stiffness than the first panel or the second panel.

18. The cover of claim 15, wherein the first panel and the connecting member do not vertically overlap and wherein the second panel and the connecting member do not vertically overlap.

19. A textile fabric having a length, a width, and a height, comprising:

a first region defined by a first plurality of textile fibers, wherein the first region has a first length that is the same as the length of the textile fabric, wherein the first region has a first width that is less than the width of the textile fabric, and wherein the first region has a first height that defines the height of the textile fabric in the first region of the textile fabric;

a second region adjacent to and non-overlapping with the first region, wherein the second region has a second length that is the same as the length of the textile fabric, wherein the second region has a second width that is greater than the first width and less than the width of the textile fabric, wherein the second region has a second height that defines the height of the textile fabric in the second region of the textile fabric, wherein the second region comprises a second plurality of textile fibers and a hot melt material positioned on the second plurality of textile fibers, and wherein the first region is free of hot melt material; and a third region adjacent to and non-overlapping with the first region, wherein the third region has a third length that is the same as the length of the textile fabric, wherein the third region has a third width that is greater than the first width and less than the width of the textile fabric, wherein the third region has a third height that defines the height of the textile fabric in the third region of the textile fabric, wherein the third region comprises a third plurality of textile fibers and an additional hot melt material positioned on the third plurality of textile fibers, wherein the first region is interposed between the second and third regions, wherein the second and third regions are stiffer than the first region, wherein the first region has a longitudinal axis that extends along the first length, and wherein the third region is configured to rotate relative to the second region about the longitudinal axis.

20. The textile fabric of claim 19, wherein the third region is configured to rotate relative to the second region about the longitudinal axis while the first and second regions are planar.

* * * * *